US007530128B2

(12) United States Patent
Wu

(10) Patent No.: US 7,530,128 B2
(45) Date of Patent: May 12, 2009

(54) INFLATABLE PAD WITH RECREATION FUNCTION

(76) Inventor: Hsin-Tsai Wu, 1F, No. 19, Alley 3, Lane 10, Sec. 3, Min-Chuan E. Rd., Taipei City, Taiwan (CN)

( * ) Notice: Subject to any disclaimer, the term of this patent is extended or adjusted under 35 U.S.C. 154(b) by 105 days.

(21) Appl. No.: 11/895,965

(22) Filed: Aug. 27, 2007

(65) Prior Publication Data

US 2008/0148488 A1 Jun. 26, 2008

(30) Foreign Application Priority Data

Dec. 26, 2006 (CN) ..... 2006 2 0155653 U

(51) Int. Cl.
*A47C 27/10* (2006.01)

(52) U.S. Cl. ..... 5/712; 5/710

(58) Field of Classification Search ..... 5/706, 5/710–713, 655.3
See application file for complete search history.

(56) References Cited

U.S. PATENT DOCUMENTS 2,655,369 A * 10/1953 Musilli ..... 267/113
5,598,593 A * 2/1997 Wolfe ..... 5/710

* cited by examiner

*Primary Examiner*—Fredrick Conley
(74) *Attorney, Agent, or Firm*—David N. Lathrop, Esq.; Gallagher & Lathrop

(57) ABSTRACT

An inflatable pad includes an inflatable pad body having a transparent surrounding layer that cooperates with a first outer layer and a transparent second outer layer to define an inflatable space. The inflatable space is divided by an interlayer unit into a first inflatable space portion disposed adjacent to the first outer layer and provided with tubular reinforcing units therein, and a second inflatable space portion disposed adjacent to the second outer layer and in fluid communication with the first inflatable space portion via a through hole unit in the interlayer unit. A ball body is disposed movably in the second inflatable space portion. The inflatable pad serves as a bed when the first outer layer is disposed above the second outer layer and as a playing device when the second outer layer is disposed above the first outer layer.

9 Claims, 6 Drawing Sheets

INFLATABLE PAD WITH RECREATION FUNCTION

CROSS-REFERENCE TO RELATED APPLICATION

This application claims priority of Chinese Application No. 200620155653.8, filed on Dec. 26, 2006.

BACKGROUND OF THE INVENTION

1. Field of the Invention

The invention relates to an inflatable pad, more particularly to an inflatable pad with a recreation function.

2. Description of the Related Art

An inflatable device, such as an inflatable pad, an inflatable bed or an inflatable chair, can be used in outdoor activities, such as camping. A conventional inflatable pad merely serves as a pad. Therefore, it is desirable to design an inflatable pad with a recreation function.

SUMMARY OF THE INVENTION

Therefore, the object of the present invention is to provide an inflatable pad that has a recreation function.

According to the present invention, an inflatable pad comprises:

an inflatable pad body having a first outer layer, a transparent second outer layer opposite to the first outer layer in a vertical direction, and a transparent surrounding layer interconnecting peripheries of the first and second outer layers and cooperating with the first and second outer layers to define an inflatable space;

an interlayer unit disposed in the inflatable space in the inflatable pad body and having a periphery connected fixedly to the surrounding layer such that the inflatable space is divided into a first inflatable space portion disposed adjacent to the first outer layer, and a second inflatable space portion disposed adjacent to the second outer layer, the interlayer unit being formed with a through hole unit such that the first inflatable space portion is in fluid communication with the second inflatable space portion via the through hole unit;

a plurality of tubular reinforcing units disposed in the first inflatable space portion of the inflatable space and interconnecting the first outer layer and the interlayer unit; and a ball body disposed movably in the second inflatable space portion of the inflatable space.

The inflatable pad is operable in a selected one of a bed state, where the first outer layer is disposed above the second outer layer and where the inflatable pad serves as a bed, and a playing state, where the second outer layer is disposed above the first outer layer and where the inflatable pad is operable to move the ball body on the interlayer unit so that the inflatable pad serves as a playing device.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
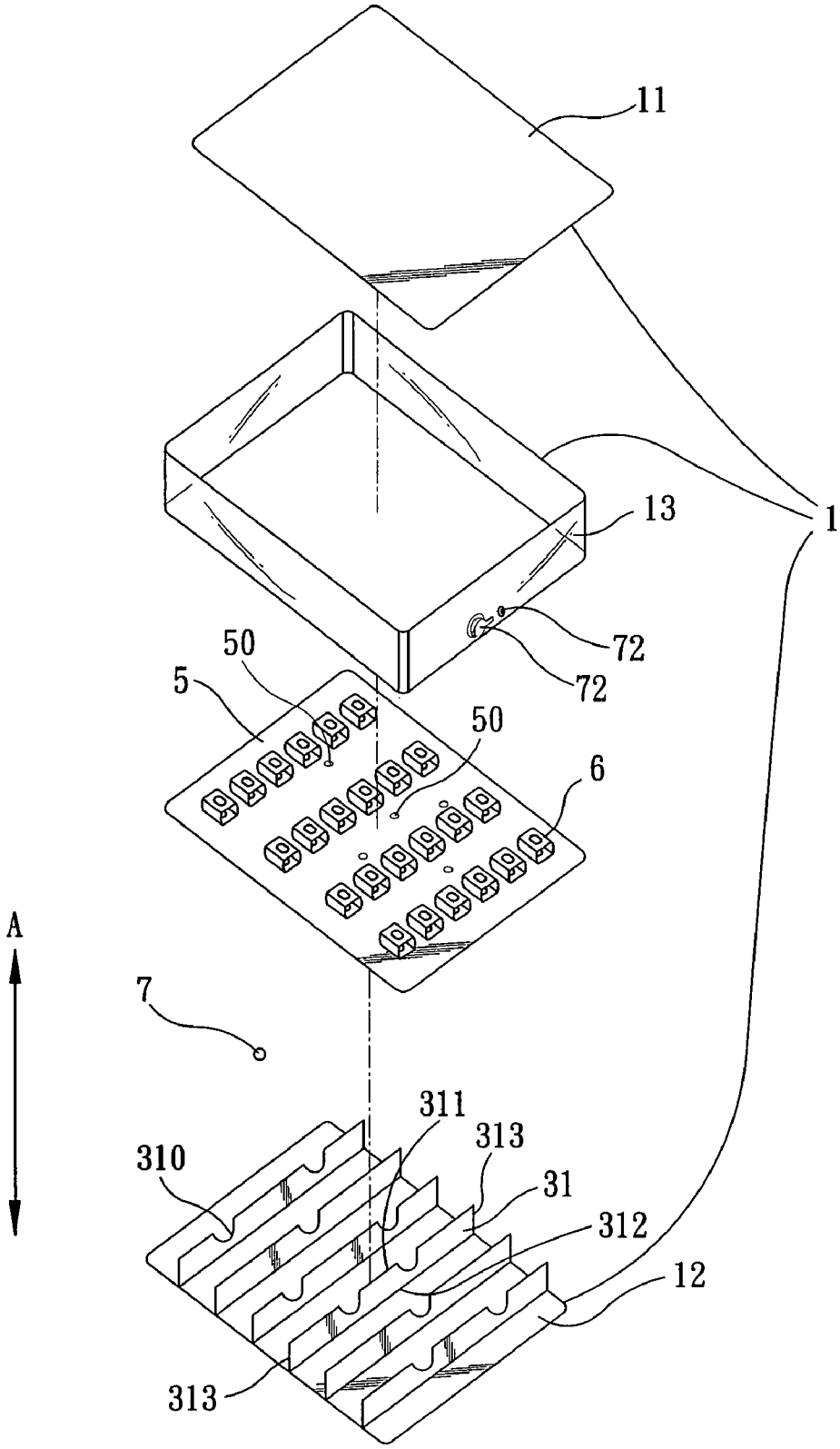
FIG. 1 is a partly exploded perspective view showing the first preferred embodiment of an inflatable pad according to the present invention.

Before the present invention is described in greater detail, it should be noted that like elements are denoted by the same reference numerals throughout the disclosure.

Referring to FIGS. 1 to 4, the first preferred embodiment of an inflatable pad according to the present invention is shown to include an inflatable pad body 1, an interlayer unit, a plurality of tubular reinforcing units 6, and a ball body 7.

Figure 3:
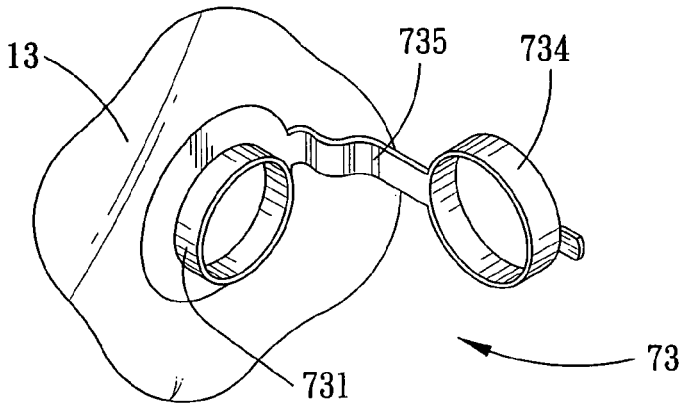
FIG. 3 is a perspective view showing a ball-access valve of the first preferred embodiment.

The inflatable pad body 1 has a first outer layer 11, a transparent second outer layer 12 opposite to the first outer layer 11 in a vertical direction (A), and a transparent surrounding layer 13 interconnecting peripheries of the first and second outer layers 11, 12 and cooperating with the first and second outer layers 11, 12 to define an inflatable space 4. The surrounding layer 13 is formed with an air valve 72, and a ball-access valve 73 that has a tubular valve seat 731, a valve cap 734 for detachably closing the valve seat 731, and a connecting belt 735 interconnecting the valve seat 731 and the valve cap 734, as shown in FIG. 3.

Figure 2:
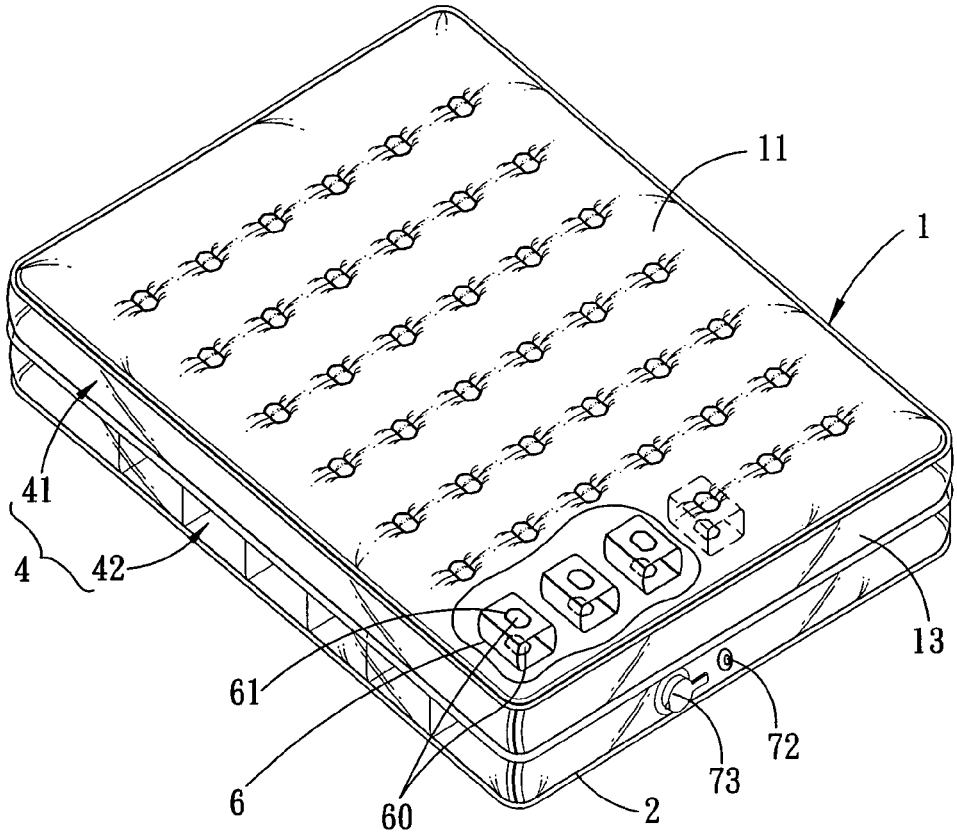
FIG. 2 is a perspective, partly cutaway view showing the first preferred embodiment when in a bed state.

In this embodiment, the interlayer unit includes an interlayer 5 disposed in the inflatable space 4 in the inflatable pad body 1 and having a periphery connected fixedly to the surrounding layer 13 such that the inflatable space 4 is divided into a first inflatable space portion 41 disposed adjacent to the first outer layer 11, and a second inflatable space portion 42 disposed adjacent to the second outer layer 12, as shown in FIG. 2. The interlayer 5 is formed with a through hole unit such that the first inflatable space portion 41 is in fluid communication with the second inflatable space portion 42 via the through hole unit. In this embodiment, the through hole unit includes a plurality of through holes 50.

The tubular reinforcing units 6 are disposed in the first inflatable space portion 41 of the inflatable space 4, are arranged in an array, and interconnect the first outer layer 11 and the interlayer 5. In this embodiment, as shown in FIG. 2, each of the reinforcing units 6 has a looped outer surface having opposite hexagonal attaching areas 60 that face respectively the first outer layer 11 and the interlayer 5. A periphery 61 of each attaching area 60 is attached fixedly to a corresponding one of the first outer layer 11 and the interlayer 5 by thermal welding.

The ball body 7 is disposed movably in the second inflatable space portion 42 of the inflatable space 4.

In this embodiment, the inflatable pad further includes a plurality of straight reinforcing belts 31 disposed spacedly in the second inflatable space portion 42. As shown in FIG. 1, each reinforcing belt 31 has first and second sides 311, 312 opposite to each other in the vertical direction (A) and connected fixedly and respectively to the interlayer 5 and the second outer layer 12, and opposite lateral ends 313 connected fixedly to the surrounding layer 13. The first side 311 of each reinforcing belt 31 is formed with at least one notch 310 that permits the ball body 7 to pass therethrough.

Figure 4:
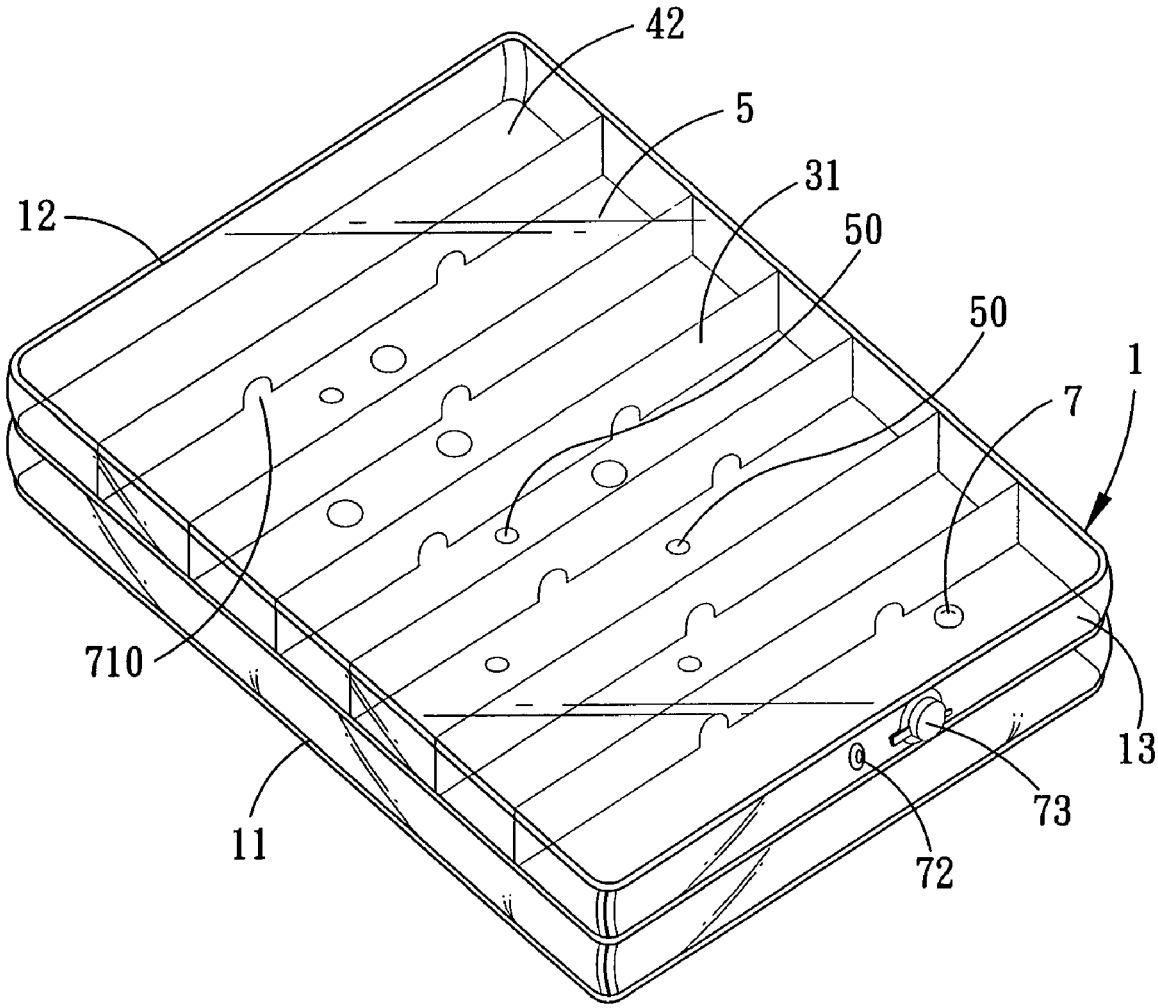
FIG. 4 is a perspective view showing the first preferred embodiment when in a playing state.

In use, the inflatable pad is operable in a selected one of a bed state, where the first outer layer 11 is disposed above the second outer layer 12 and where the inflatable pad serves as a bed, as shown in FIG. 2, and a playing state, where the second outer layer 12 is disposed above the first outer layer 11 and where the inflatable pad is operable to move the ball body 7, for example, from a side to an opposing side of the inflatable pad body 1 on the interlayer 5 and in the second inflatable space portion 42 of the inflatable space 4 so that the inflatable pad serves as a playing device, as shown in FIG. 4. In this embodiment, the through holes 50 are designed to have a size slightly smaller than that of the ball body 7 so that the ball body 7 may be trapped in one of the through holes 50 when the inflatable pad is operated in the playing state, thereby increasing difficulties in playing a game. Alternatively, when the size of the through holes 50 is much smaller that of the ball body 7, the ball body 7 is unable to be trapped in any one of the through holes 50.

Figure 5:
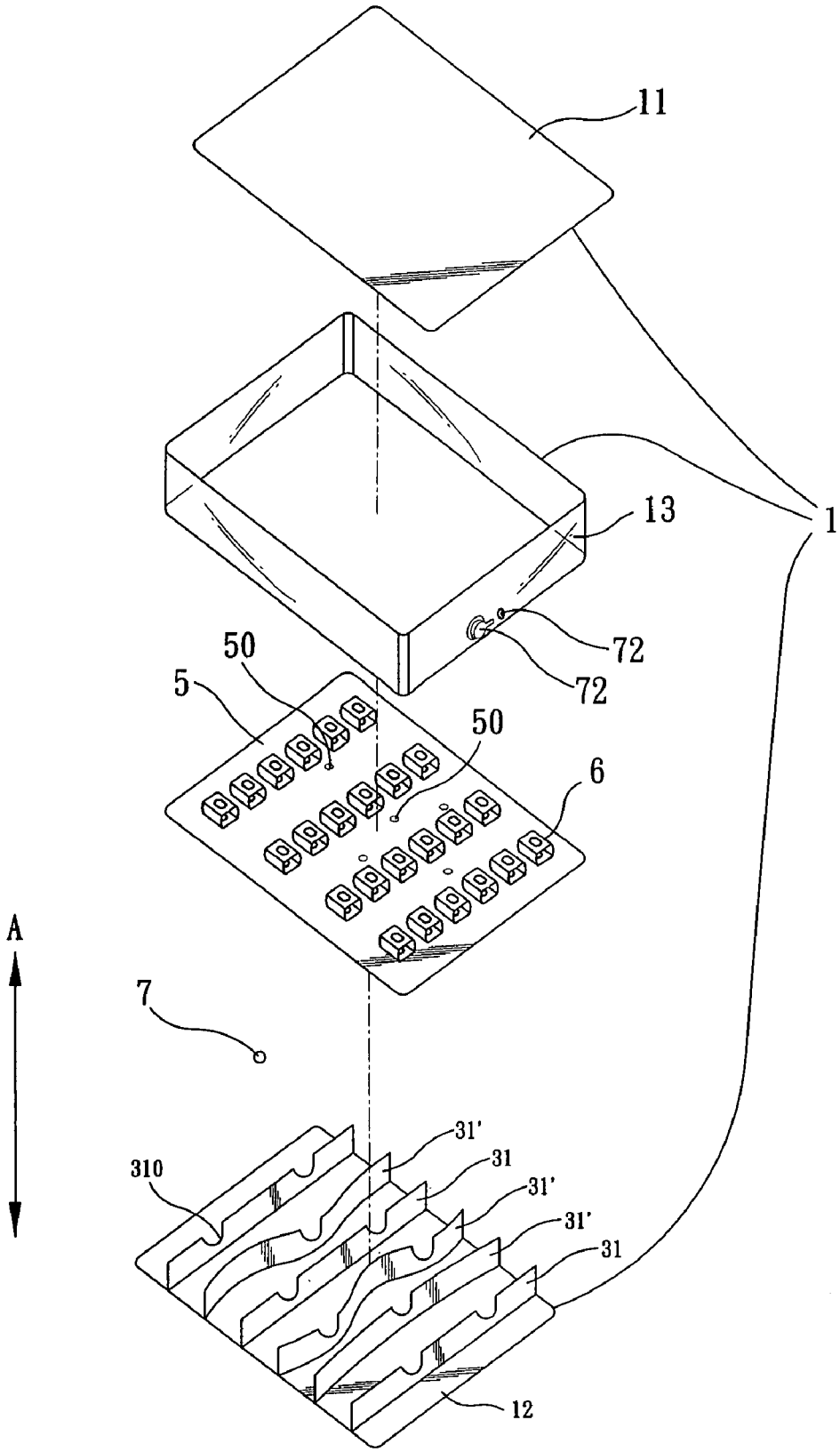
FIG. 5 is a partly exploded perspective view showing the second preferred embodiment of an inflatable pad according to the present invention.

FIG. 5 illustrates the second preferred embodiment of an inflatable pad according to this invention, which is a modification of the first preferred embodiment. Unlike the first preferred embodiment, the reinforcing belts 31' are curved.

Figure 6:
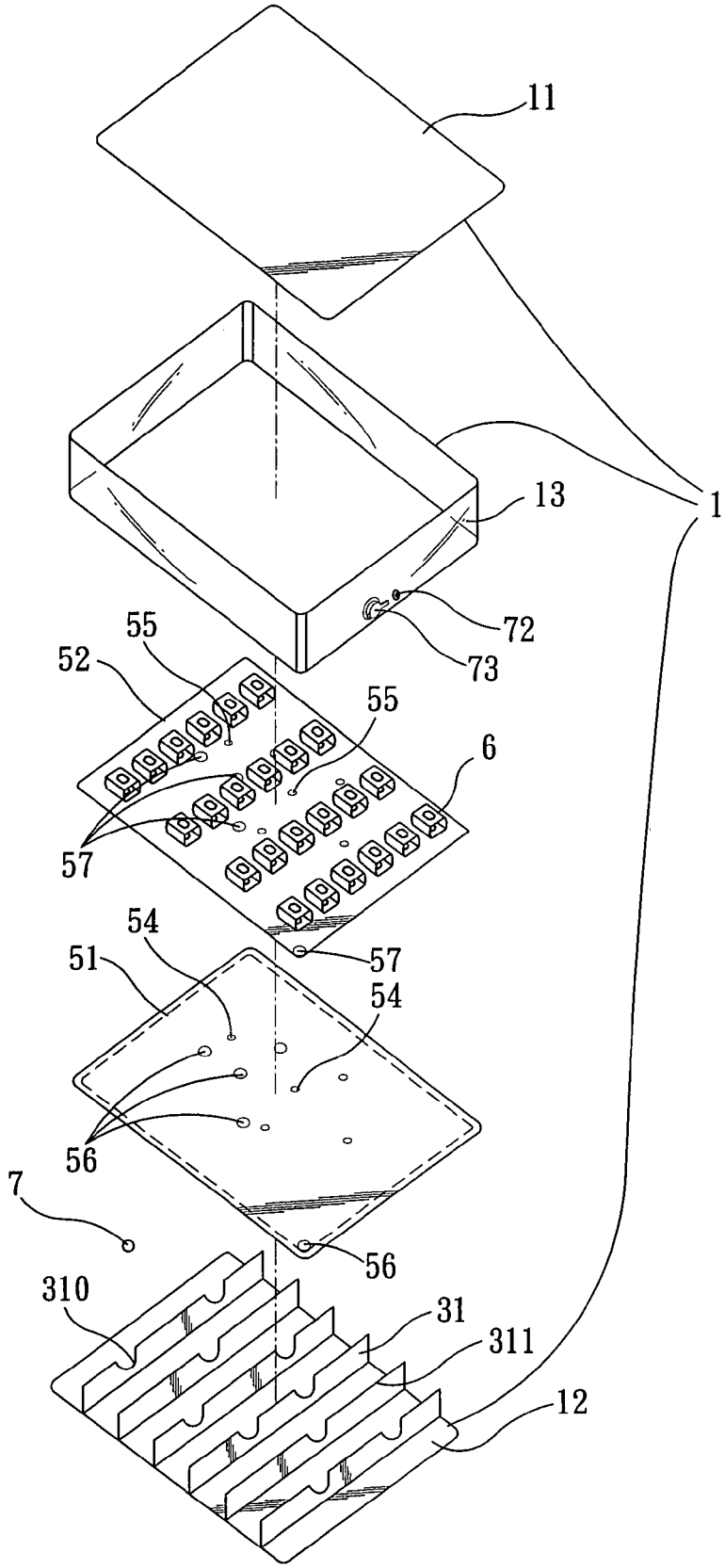
FIG. 6 is a partly exploded perspective view showing the third preferred embodiment of an inflatable pad according to the present invention.
Figure 7:
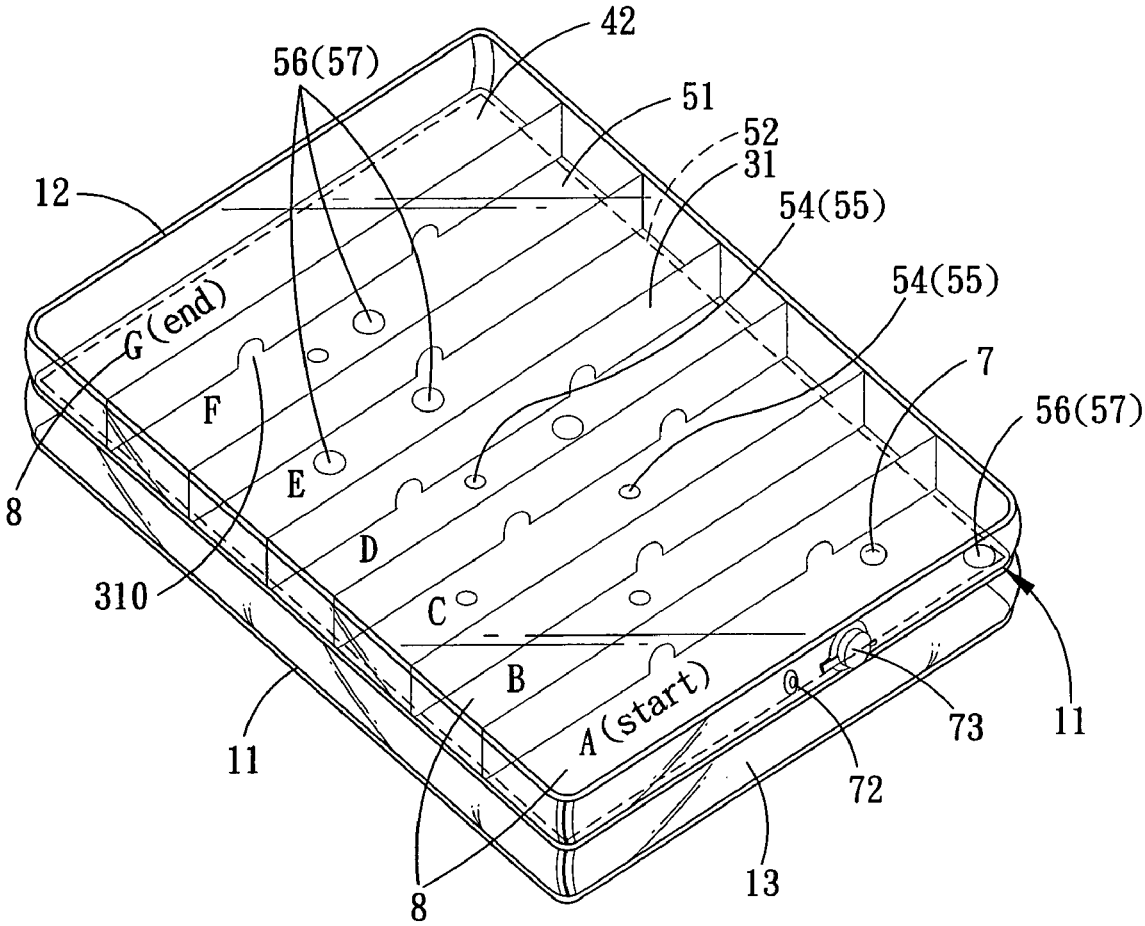
FIG. 7 is a perspective view showing the third preferred embodiment when in a playing state.

FIGS. 6 and 7 illustrate the third preferred embodiment of an inflatable pad according to this invention, which is a modification of the first preferred embodiment. In this embodiment, the interlayer unit includes a connecting interlayer 51 and a reinforcing interlayer 52. The connecting interlayer 51 is disposed adjacent to the second outer layer 12, has the periphery connected fixedly to the surrounding layer 13, and is connected to the first sides 311 of the reinforcing belts 31. The reinforcing interlayer 52 is disposed adjacent to the first outer layer 11, has a size slightly smaller than that of the connecting interlayer 51, and is attached fixedly to the connecting interlayer 51. The reinforcing interlayer 52 is connected to the tubular reinforcing units 6.

Furthermore, the through hole unit includes a plurality of first through holes 54 formed in the connecting interlayer 51, a plurality of second through holes 55 formed in the reinforcing interlayer 52 and corresponding respectively to the first through holes 54, a plurality of third through holes 56 formed in the connecting interlayer 51, and a plurality of fourth through holes 57 formed in the reinforcing interlayer 52 and corresponding respectively to the third through holes 56. In this embodiment, the first and second through holes 54, 55 have a size smaller than that of the ball body 7, while the third and fourth through holes 56, 57 have a size larger than that of the ball body 7 such that it is possible for the ball body 7 to pass through two corresponding ones of the third and fourth through holes 56, 57 in the connecting and reinforcing interlayers 51, 52 and into the first inflatable space portion 41 during operation in the playing state, thereby increasing difficulties in playing a game. It is noted that two corresponding ones of the third and fourth through holes 56, 57 are disposed adjacent to one corner of the inflatable pad body 1 (see FIG. 7), thereby facilitating return of the ball body 7 in the first inflatable space portion 41 to the second inflatable space portion 42 therethrough.

Moreover, as shown in FIG. 7, the connecting interlayer 51 of the interlayer unit has a side surface formed with patterns 8, such as "start" indicating a game starting side, "end" indicating a game ending side, and "A, B, C, D, E, F, G" indicating various indicators related to different game scores.

In sum, the inflatable pad of the present invention not only serves as a bed when operated in the bed state, but also serves as a playing device when operated in the playing state, thereby providing a recreation function.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An inflatable pad comprising:

an inflatable pad body having a first outer layer, a transparent second outer layer opposite to said first outer layer in a vertical direction, and a transparent surrounding layer interconnecting peripheries of said first and second outer layers and cooperating with said first and second outer layers to define an inflatable space;

an interlayer unit disposed in said inflatable space in said inflatable pad body and having a periphery connected fixedly to said surrounding layer such that said inflatable space is divided into a first inflatable space portion disposed adjacent to said first outer layer, and a second inflatable space portion disposed adjacent to said second outer layer, said interlayer unit being formed with a through hole unit such that said first inflatable space portion is in fluid communication with said second inflatable space portion via said through hole unit;

a plurality of tubular reinforcing units disposed in said first inflatable space portion of said inflatable space and interconnecting said first outer layer and said interlayer unit; and a ball body disposed movably in said second inflatable space portion of said inflatable space;

wherein said inflatable pad is operable in a selected one of a bed state, where said first outer layer is disposed above said second outer layer and where said inflatable pad serves as a bed, and a playing state, where said second outer layer is disposed above said first outer layer and where said inflatable pad is operable to move said ball body on said interlayer unit so that said inflatable pad serves as a playing device.

2. The inflatable pad as claimed in claim 1, wherein:

said interlayer unit includes an interlayer connected to said tubular reinforcing units and formed with said through hole unit; and said through hole unit includes a plurality of through holes having a size smaller than that of said ball body.

3. The inflatable pad as claimed in claim 2, further comprising a plurality of reinforcing belts disposed spacedly in said second inflatable space portion, each of said reinforcing belts having first and second sides opposite to each other in the vertical direction and connected fixedly and respectively to said interlayer and said second outer layer, and opposite lateral ends connected fixedly to said surrounding layer, said first side of each of said reinforcing belts being formed with at least one notch that permits said ball body to pass therethrough.

4. The inflatable pad as claimed in claim 3, wherein at least one of said reinforcing belts is curved.

5. The inflatable pad as claimed in claim 1, wherein:

said interlayer unit includes a connecting interlayer disposed adjacent to said second outer layer and having said periphery connected fixedly to said surrounding layer, and a reinforcing interlayer disposed adjacent to said first outer layer, having a size slightly smaller than that of said connecting interlayer, and attached fixedly to said connecting interlayer, said reinforcing interlayer being connected to said tubular reinforcing units; and said through hole unit includes a plurality of first through holes formed in said connecting interlayer, a plurality of second through holes formed in said reinforcing interlayer and corresponding respectively to said first through holes, a plurality of third through holes formed in said connecting interlayer, and a plurality of fourth through holes formed in said reinforcing interlayer and corresponding respectively to said third through holes, said first and second through holes having a size smaller than that of said ball body, said third and fourth through holes having a size larger than that of said ball body.

6. The inflatable pad as claimed in claim 5, wherein two corresponding ones of said third and fourth through holes are disposed adjacent to one corner of said inflatable pad body.

7. The inflatable pad as claimed in claim 5, further comprising a plurality of reinforcing belts disposed spacedly in said second inflatable space portion, each of said reinforcing belts having first and second sides opposite to each other in the vertical direction and connected fixedly and respectively to said connecting interlayer and said second outer layer, and opposite lateral ends connected fixedly to said surrounding layer, said first side of each of said reinforcing belts being formed with at least one notch that permits said ball body to pass therethrough.

8. The inflatable pad as claimed in claim 5, wherein said connecting interlayer has a patterned side surface facing said second outer layer.

9. The inflatable pad as claimed in claim 1, wherein said surrounding layer is formed with an air valve, and a ball-access valve.

* * * * *